US005806330A

United States Patent [19]

Falkowski et al.

[11] Patent Number: 5,806,330

[45] Date of Patent: Sep. 15, 1998

[54] METHOD OF CONTROLLING A REFRIGERATION SYSTEM AND FILTER/DRIER/RECEIVER THEREFOR

[75] Inventors: Francis Falkowski, Oxford, Mich.; Dennis K. Seals; James L. Bedore, both of Sanford, N.C.; Wayne K. Hutchison, St. Thomas, Canada

[73] Assignee: Eaton Corporation, Cleveland, Ohio

[21] Appl. No.: 567,677

[22] Filed: Dec. 5, 1995

[51] Int. Cl.[6] ..... F25B 49/02

[52] U.S. Cl. ..... 62/184; 2/228.4; 2/509

[58] Field of Search ..... 62/228.1, 228.3, 62/184, 509, 174, 126, 129

[56] References Cited

U.S. PATENT DOCUMENTS 3,637,005 1/1972 Nussbaum ..... 62/174

4,707,999 11/1987 Ohta et al. ..... 62/509 X 5,038,582 8/1991 Takamatsu ..... 62/509 X 5,249,431 10/1993 Kuribara et al. ..... 62/129

5,415,014 5/1995 Waldschmidt et al. ..... 62/509

*Primary Examiner*—Harry B. Tanner

*Attorney, Agent, or Firm*—Roger A. Johnston

[57] ABSTRACT

A thermistor probe is formed in a closed end tube and the probe is inserted through the header of a receiver/drier in a refrigeration system for sensing the temperature of the saturated refrigerant vapor in the receiver/drier. The sensed temperature is employed to energize and de-energize the refrigerant pump or compressor. The sensed temperature is also employed to energize and de-energize the refrigerant condenser fan motor.

5 Claims, 2 Drawing Sheets

METHOD OF CONTROLLING A REFRIGERATION SYSTEM AND FILTER/DRIER/RECEIVER THEREFOR

BACKGROUND OF THE INVENTION

The present invention relates to refrigeration or air conditioning systems and particularly air conditioning systems employed for cabin or occupant compartment cooling of motor vehicles. In such motor vehicle air conditioning systems, particularly those employed in passenger cars, it is common practice to provide a filter/drier/receiver canister in the refrigerant circulation line and disposed between the condenser and the expander. Typically the filter/drier/receiver contains dessicant material for removing moisture from the liquid refrigerant and filter material to prevent foreign particles from damaging the compressor or refrigerant pump. In stationary refrigeration systems it is common practice to employ the capillary tube for performing the function of the expander; whereas, in refrigeration systems employed for cooling motor vehicle occupant compartments it is common practice to utilize a refrigerant expansion control valve for providing low pressure flow to the evaporator.

In a typical motor vehicle occupant compartment air conditioning system, the refrigerant pump or compressor is driven from the vehicle drive motor by means of a belt driving a pulley on the compressor which is coupled by an electrically energizeable clutch which drivingly connects the pulley to the compressor. Such motor vehicle air conditioning systems also typically have an electrically operated motor driven fan for circulating ambient air over the condenser to facilitate cooling and liquification of the compressed gaseous refrigerant.

Heretofore, a technique which has been in widespread usage in automotive air conditioning systems has utilized a pressure switch mounted in the refrigeration conduit between the condenser and the expander for sensing upper and lower limits of refrigerant pressure and making and breaking an electrical circuit for controlling either or both of the condenser cooling fan and compressor drive clutch. The mounting of a pressure switch in the refrigerant system in the high pressure side between the condenser and expander and the robustness of the pressure switch itself have proven to be sources of problems in mass production during assembly and in service in automotive air conditioning systems. Therefore, it has been desired to provide a convenient low cost way or means of eliminating the pressure switch and providing control of the refrigeration system in a manner which is reliable in service and suitable for high-volume mass-production of motor vehicles.

SUMMARY OF THE INVENTION

The present invention provides a unique and novel means and method for controlling cycling of the compressor clutch and condenser fan in a refrigeration system and is particularly suitable for air conditioning systems employed for motor vehicle occupant compartments where widely varying thermal loads on the system result in relatively short duty cycles for the compressor and condenser fan.

It is thus an object of the present invention to provide a simplified and low-cost technique for controlling the compressor clutch and condenser fan in an air conditioning system in a manner which eliminates the need for a pressure switch in the refrigerant line.

The system of the present invention utilizes a filter/drier/receiver disposed in the refrigerant line between the condenser and expander and a thermistor extends through the closure header of the filter/drier/receiver canister and senses the saturation temperature of the refrigerant therein and provides an electrical control signal indicative of the sensed temperature. An electronic controller is employed to electrically control energization and de-energization of the compressor clutch and condenser fan motor responsive to the electrical signal from the thermistor in accordance with a predetermined program. In a system which employs an electrically operated expansion valve as the expander, the controller may also be programmed to control operation of the expansion valve in response to the sensed temperature from the thermistor.

DETAILED DESCRIPTION

Figure 1:
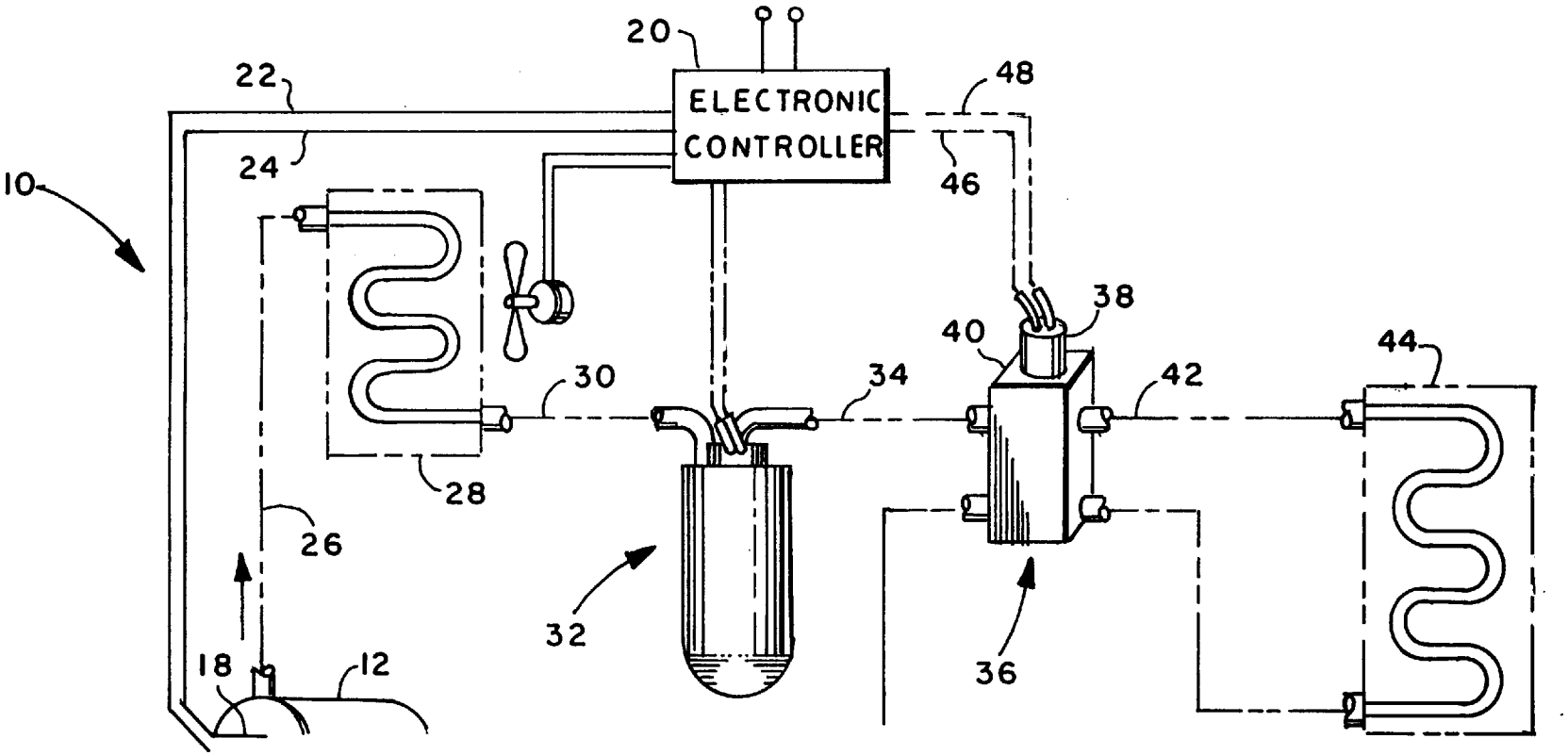
FIG. 1 is a pictorial schematic of a refrigeration system employing the present invention.

Referring to FIG. 1, a refrigeration system is indicated generally at 10 and includes a pump or compressor 12 operated by a pulley 14 driven by power belt 16 and connected to the compressor by an electrically energizeable clutch 18 which is connected to an electronic controller 20 by leads 22, 24.

The compressor 12 pumps compressed refrigerant gas through conduit 26 to the inlet of a condenser 28 which discharges through conduit 30 to the inlet of a filter/drier/receiver indicated generally at 32. The filter/drier/receiver 32 discharges refrigerant along conduit 34 to the inlet of an expander indicated generally at 36. In the present practice of the invention the expander 36 comprises an electrically operated thermal expansion valve employing a solenoid operator 38 mounted on the valve body 40 which controls flow to the low pressure outlet conduit 42 which is connected to the inlet of an evaporator 44. The solenoid is connected via leads 46, 48 shown in dashed outline to the controller 20. It will be understood that the expander 36 may in stationary refrigeration systems comprise a capillary tube in place of an expansion control valve.

The evaporator 44 discharges vaporized refrigerant at low pressure through conduit 50 which passes through the valve block 40 to the inlet of the compressor 12. The conduit 50 is in heat conducting relationship with the valve block 40 to permit a temperature responsive fluid filled operator to be substituted for the solenoid 38 as is the case for a system which utilizes an alternative type of expander comprising a mechanically operated thermal expansion valve.

Figure 2:
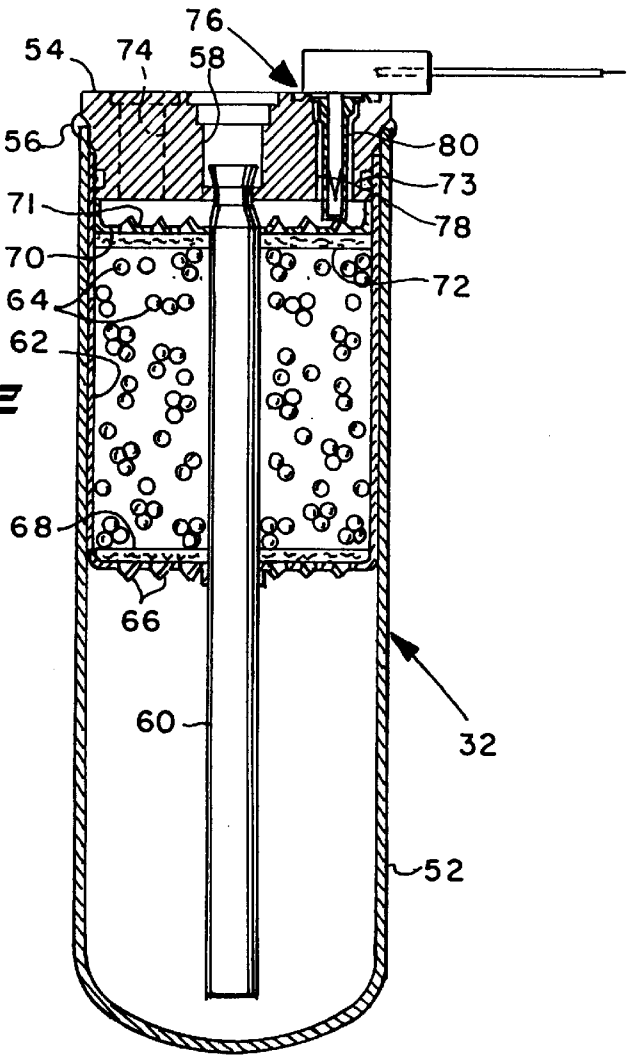
FIG. 2 is an enlarged section view of the filter/drier/receiver employed in the embodiment of FIG. 1.

Referring to FIG. 2, the filter/drier/receiver 32 is shown in greater detail as having a closed end canister 52 closed at one end by a header block 54 secured thereto by peripheral weldment denoted by reference numeral 56.

Header 54 has an outlet port 58 which has one end of conduit 34 attached thereto but which attachment has been omitted in FIG. 2. Outlet port 58 also has the upper end of a standpipe 60 connected thereto and which extends downwardly into the canister 52 and terminates in close proximity to the closed lower end thereof. Standpipe 60 extends through a basket 62 which contains dessicant material 64 preferably in granular form; and, the lower end of the basket is perforated as shown by reference numeral 66 and has a layer of filter material 68 disposed adjacent the perforation. The upper end of the basket 62 is closed by a perforated closure 70 having perforations 71 and which also has a layer of filter material 72 disposed adjacent the undersurface thereof. The upper end of the basket 62 is secured to the header by any suitable expedient as for example staking into a groove 73 formed peripherally about the header. In the presently preferred practice of the invention the header 54, canister 52, and basket 62 are formed of aluminum material. An inlet port 74 is shown in dashed outline in FIG. 2 as formed in the header 54; and, the inlet port 74 is connected to one end of conduit 30.

A thermistor probe assembly indicated generally at 76 is received in a sensing port 78 formed in header 54.

Figure 3:
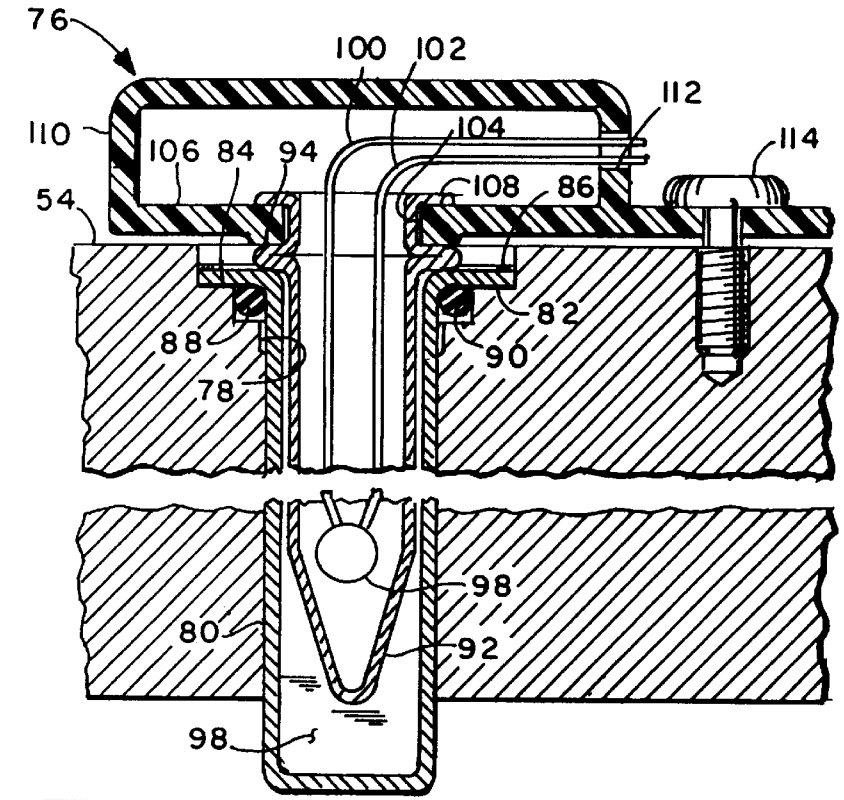
FIG. 3 is an enlarged view of the thermistor in FIG. 2.

Referring to FIGS. 2 and 3, probe assembly 76 includes a closed end tubular member 80 which extends downwardly into sensing port 78 and through the header; and, tubular member 80 is exposed to the refrigerant circulating in the interior of cannister 52.

The upper end of tubular member 80 has a radially outwardly extending flange 82 formed thereon, which flange is registered in the bottom of a counterbore 84 formed in the port 78 and secured thereagainst by material displacement of the header, as for example, orbital staking denoted by reference numeral 86. A suitable seal ring 88 is provided on the undersurface of the flange 82 and seals between the exterior of tubular member 80 and a groove 90 formed in the header.

A probe tube 92 or casing has one end thereof closed, and preferably conically tapered, and has the opposite end thereof open with a convolution or flange 94 formed adjacent the open end; and, the tube 92 is received in the tubular member 80 and packed therearound with a thermally conductive medium as indicated by numeral 96 and which in the presently preferred practice of the invention comprises a thermally conductive grease. Thermistor 98 has a pair of electrical leads 100, 102 extending therefrom and outwardly through the open end of tube 92.

The upper open end of tube 92 is received through an aperture 104 formed in a housing deck 106; and, the end of the tube 92 is deformed or flared outwardly thereover to form a retaining flange 108 which retains the tube in the deck sandwiched between convolution 94 and flange 108. Housing deck 106 has a cover 110 received thereover and attached to the deck 106 by any suitable expedient, as for example, adhesives or non-metallic weldment. The leads 100, 102 extend outwardly through an aperature 112 formed in the cover 110 for external electrical connection thereto. The housing deck 106 with the probe tube 92 attached thereto is assembled into the tubular member 80; and, the housing deck 106 is secured to header 54 by a suitable fastener such as screw 114 threaded into the header.

Figure 4:
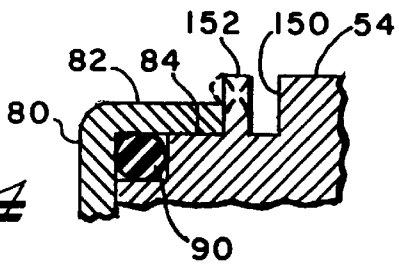
FIG. 4 is an enlarged portion of an alternate embodiment of FIG. 3.

Referring to FIG. 4 an alternate technique for securing the tubular member 80 onto the header 54 is illustrated wherein a groove 150 is formed in the header 54 adjacent the side of the counterbore 84 so as to form a rib 152 which is subsequently deformed or crimped over the edge of the tube flange 82, by any suitable expedient, to the position shown in dashed outline.

Although the invention has been described above with respect to the illustrated embodiment, it will be understood that the invention is capable of variations and modifications and is limited only by the scope of the following claims.

We claim:

1. A filter/drier/receiver assembly for refrigerant circulated in a refrigeration system comprising:

(a) a cup-shaped canister with dessicant material therein and having a header closing said cup-shape with an inlet and outlet adapted for connection to refrigerant conduits;

(b) a sensing port formed in said header with a generally thin walled tubular member having a closed end received in said port and an open end communicating with the exterior of said canister and sealed thereabout and retained in said port;

(c) a thermistor disposed in a casing, said casing removably received in said tubular member with a heat conductive medium for effecting heat transfer between said thin walled tubular member and said thermistor.

2. The assembly defined in claim 1, wherein said heat conductive medium includes heat conductive grease.

3. The assembly defined in claim 1, wherein said tubular member is retained by deforming said header.

4. A method of sensing saturation temperature of the refrigerant in a refrigeration system comprising:

(a) providing a canister and disposing dessicant in said canister and closing same with a header and forming an inlet and outlet in said header;

(b) connecting said inlet to receive refrigerant from a condenser and said outlet to discharge refrigerant to an evaporator;

(c) forming a sensing port in said header and disposing and sealing a cup-shaped tubular member in said port;

(d) disposing a thermistor in a casing and disposing said casing in said cup-shaped member and effecting heat exchange between said cup-shaped member and said casing and thermistor and sensing temperature and generating an electrical signal indicative of the temperature sensed by said thermistor.

5. The method defined in claim 4, wherein said step of effecting heat exchange includes disposing thermally conductive grease in said cup-shaped member.

* * * * *